US007705702B2

(12) United States Patent
Craig

(10) Patent No.: US 7,705,702 B2
(45) Date of Patent: Apr. 27, 2010

(54) ACTUATOR

(75) Inventor: Ian Muir Craig, Broxburn (GB)

(73) Assignee: Selex Galileo Ltd, Essex (GB)

( * ) Notice: Subject to any disclaimer, the term of this patent is extended or adjusted under 35 U.S.C. 154(b) by 74 days.

(21) Appl. No.: 11/882,183

(22) Filed: Jul. 31, 2007

(65) Prior Publication Data

US 2008/0036563 A1 Feb. 14, 2008

(30) Foreign Application Priority Data

Aug. 8, 2006 (EP) ..... 06254153
Aug. 8, 2006 (GB) ..... 0915726.7

(51) Int. Cl.
*H01F 7/08* (2006.01)
*H01H 9/00* (2006.01)

(52) U.S. Cl. ..... 335/222; 335/207

(58) Field of Classification Search ..... 335/222, 335/207
See application file for complete search history.

(56) References Cited

U.S. PATENT DOCUMENTS 3,768,054 A * 10/1973 Neugebauer ..... 335/304
5,745,019 A * 4/1998 Renger ..... 335/222
6,741,151 B1 * 5/2004 Livshitz et al. ..... 335/222
2004/0012470 A1 * 1/2004 Zimmerling et al. ..... 335/207
2006/0091733 A1 5/2006 Binnard et al.
2006/0097725 A1 * 5/2006 Callaghan et al. ..... 324/318

FOREIGN PATENT DOCUMENTS

| | | |
|---|---|---|
| DE | 11 19 992 | 12/1961 |
| EP | 0 921 707 | 9/1999 |
| GB | 789726 | 1/1958 |
| GB | 860439 | 2/1961 |
| JP | 61-004456 | 1/1986 |
| JP | 10-112968 | 4/1998 |
| WO | 2004/034737 | 4/2004 |

OTHER PUBLICATIONS

European Search Report for EP 06254153.7 dated Jan. 16, 2007.
Great Britain Search Report for GB 061515726.7 dated Dec. 5, 2006.

* cited by examiner

*Primary Examiner*—Elvin G Enad
*Assistant Examiner*—Alexander Talpalatskiy
(74) *Attorney, Agent, or Firm*—Buchanan Ingersoll & Rooney PC

(57) ABSTRACT

The disclosed device and method relate to an actuator. The actuator includes a field structure assembly having an arrangement of permanent magnets and magnetically soft components, and a moving coil assembly. The arrangement of permanent magnets includes a conical magnet and a plurality of segmented ring magnets.

8 Claims, 2 Drawing Sheets

ACTUATOR

FIELD

The described embodiments relate to an actuator. In particular, the exemplary embodiments to an actuator having improved acceleration for payloads at an optimum volume and mass of actuator.

BACKGROUND

Typical moving coil assembly 100 actuators utilise radial magnets in the field structure, or axial central magnets. A typical "loudspeaker" design uses an annular axial magnet. Production of a large payload acceleration with little electrical power requires a large radial magnetic flux. To increase the magnetic flux of such designs requires that the external dimensions of the actuator be increased. This may not be an option as the space required for an increased-size actuator may not be available, so generally a compromise or work-around has to be found.

The described embodiments seek to mitigate the problems associated with the known designs described above.

SUMMARY

The exemplary embodiments provide an actuator comprising a field structure assembly comprising an arrangement of permanent magnets and magnetically soft components, and a moving coil assembly, wherein the arrangement of permanent magnets comprises a conical magnet and a plurality of segmented ring magnets.

The actuator according to the exemplary embodiments includes a magnetic assembly which allows a larger air gap to be formed in a field structure of such an actuator, allowing the coil assembly greater movement within the field structure. Such an actuator can therefore have an more optimal overall mass and volume, allowing it to fit into restricted spaces, and the moving coil assembly (as part of an angular motion mechanism) can travel through a relatively large angle respective to the fixed part. Further, the higher magnetic flux provided by the magnetic assembly is increased relative to that of conventional known designs.

DESCRIPTION OF THE DRAWINGS

Specific exemplary embodiments will now be described, by way of example only and with reference to the accompanying drawings that have like reference numerals, wherein:—

DETAILED DESCRIPTION

Figure 1:
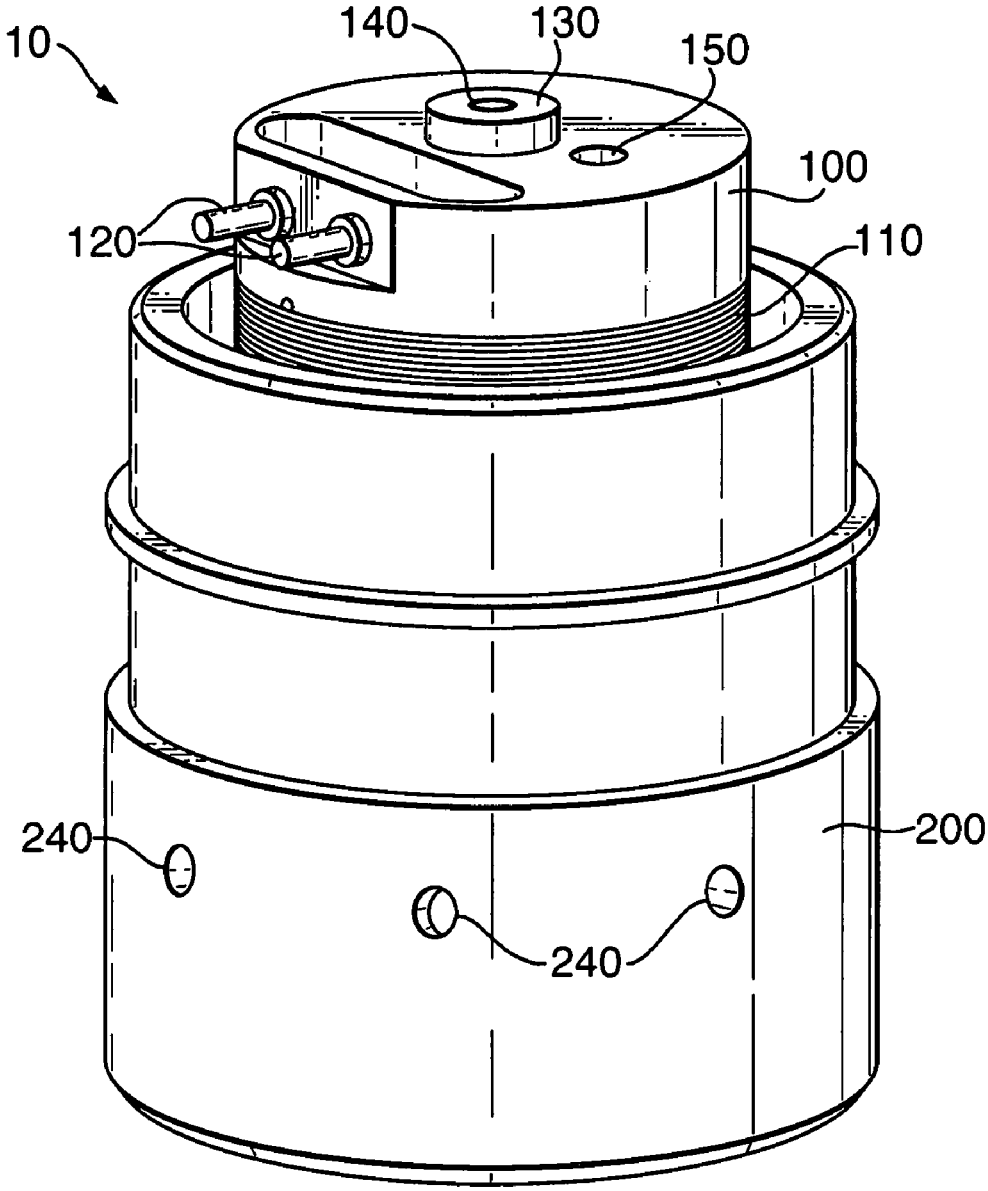
FIG. 1 is a diagram illustrating an actuator according to the present invention.
Figure 2A:
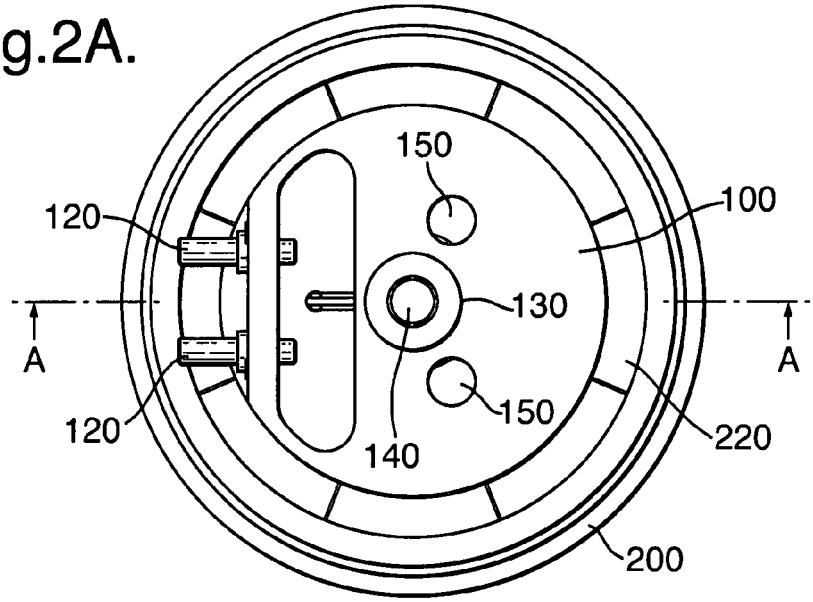
FIG. 2A is a diagram showing a plan view of the actuator according to the present invention as shown in FIGS. 1 and 2.
Figure 2B:
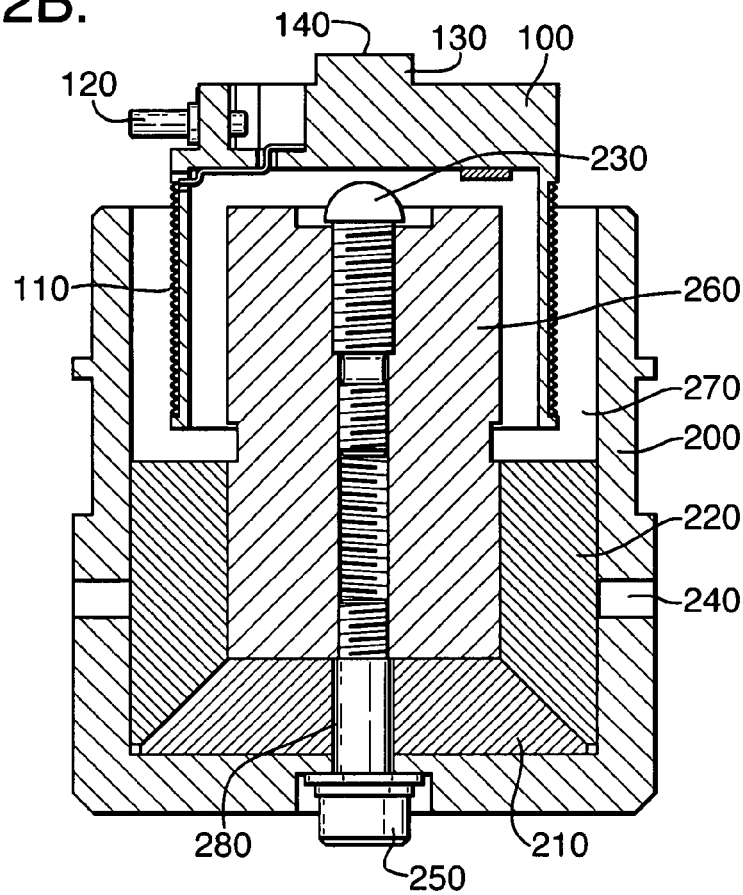
FIG. 2 is a diagram showing a cross-section of the actuator according to the present invention as shown in FIG. 1.

A specific embodiment of the invention is shown in FIGS. 1 to 3. The actuator 10 consists of two portions: a field structure assembly 200 and a coil assembly 100.

The field structure assembly 200 is a hollow cylindrical structure formed with a closed end, the closed end having a centrally-located hole 280. Along the central axis of the field structure assembly 200, there is positioned a cylindrical pole piece 260 which defines a radial space 270 between an outer surface of the pole piece 260 and the inner surface of the field outer pole 290. A retaining screw 250 is fixed through both the centrally-located hole 280 in the closed end of the field outer pole 290, and the cylindrical pole piece 260.

In the radial space 270 located towards the closed end of the field outer pole 290 there is located an arrangement of permanent magnets that form an inwardly-facing single pole face. The magnet assembly is formed from a conical magnet 210 and several segments of a ring magnet 220. The conical magnet 210 has an inclined circumferential face. The upper face of the conical magnet 210 abuts the lower surface of the pole piece 260 while the lower face of the conical magnet 210 abuts the inward-facing surface of the closed end of the field outer pole 290. The ring magnet segments 220 are provided having inner radial surfaces abutting the outer surface of the pole piece 260 and outer radial surfaces abutting the inner cylindrical walls of the field outer pole 290. The lower surfaces of the ring magnet segments 220 are inclined to co-operate with the inclined circumferential face of the conical magnet 210 such that these faces abut. The conical magnet 210 and ring magnet segments 220 are fixed in place with adhesive.

Towards the open end of the radial space 270 between the inner surface of the field outer pole 290 and the outer surface of the pole piece 260, an air gap is formed.

The coil assembly 100 is a hollow cylindrical structure with one end closed, arranged to fit within the air gap defined at the open end of the radial space 270 between the inner surface of the field outer pole 290 and the outer surface of the pole piece 260. Around the outer surface of the hollow cylindrical structure a coil 110 is provided. The cylindrical structure is selected from a material that has good thermal conductivity but is electrically non-conductive. A ceramic is a class of material that would fit this requirement. This material characteristic eliminates the production of eddy currents which are detrimental to the response time of the actuator assembly.

The field structure 200 is assembled by the following steps: First, the conical magnet 210 is placed against the inward facing surface of the field outer pole 290 and fixed in place with adhesive, the adhesive being applied between the inward facing surface of the closed end of the field outer pole 290 and the conical magnet 210. Next, the segments of the ring magnet 220 are inserted to abut the inner surface of the field outer pole 290 and the inclined circumferential surface of the conical magnet 210 using a specially designed tool that forces the magnets to remain in place. While the magnets are retained in place, they are fixed in place with adhesive injected through adhesive holes 240 provided in the field outer pole 290. Then the pole piece 260 is inserted into the gap defined by the conical magnet 200 and assembled ring magnet segments 220. The pole piece 260 is retained in place with a retaining screw 250 inserted through a centrally located hole 280 in the closed end of the field outer pole 290. An end stop 230 is then inserted into the still open end of the shaft in the pole piece 260 to act as a shock absorber for when, in use, the coil assembly 100 strikes the top of the end stop 230.

Due to the novel magnetic topology created by the above described arrangement of magnets, the actuator 10 can move a mirror connected to the mating point 140 of the coil assembly 100 through a relatively large angle as the large air gap allows a large range of movement and the significant radial magnetic flux allows large payload acceleration at an optimum volume and mass of the actuator 10.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An actuator comprising a field structure assembly comprising an arrangement of permanent magnets and magnetically soft components, and a moving coil assembly; wherein the arrangement of permanent magnets comprises a conical magnet and a plurality of ring magnet segments; a cylindrical field structure having a closed end and an open end wherein a magnetic assembly and a pole piece are provided inside the cylindrical field structure; wherein the pole piece includes a centrally-located hole, and wherein the pole piece receives a retaining screw in the centrally-located hole.

2. The actuator according to claim 1, wherein the moving coil assembly comprises a cylindrical coil assembly having a closed end and an open end and comprising one or more terminals and a coil.

3. The actuator according to claim 1, wherein an air gap is defined between a remaining portion of the outer surface of the pole piece and an inside surface of the open end of the field structure and wherein the open end of the coil assembly is operable to fit into the air gap between the outer surface of the pole piece and the inside surface of the open end of the field structure.

4. The actuator according to claim 1, wherein the field structure assembly magnet is disposed at the closed end of the field structure.

5. The actuator according to claim 1, wherein the conical magnet has an inclined circumferential face.

6. The actuator according to claim 1, wherein an upper face of the conical magnet abuts a lower surface of the pole piece and a lower face of the conical magnet abuts an inward-facing surface of the closed end of the cylindrical field structure.

7. The actuator according to claim 1, wherein each segmented ring magnet has an inner radial surface that abuts an outer surface of the cylindrical field structure and an outer radial surface that abuts an inner wall of the cylindrical field structure.

8. The actuator according to claim 5, wherein each segmented ring magnet has an inclined lower surface that mates with the inclined circumferential face of the conical magnet.

* * * * *